US012617516B2

(12) United States Patent
Shinoda et al.

(10) Patent No.: US 12,617,516 B2
(45) Date of Patent: May 5, 2026

(54) CONTROL DEVICE AND CONTROL METHOD

(71) Applicant: TOYOTA JIDOSHA KABUSHIKI KAISHA, Toyota (JP)

(72) Inventors: Yoshihisa Shinoda, Shizuoka-ken (JP); Isao Kobayashi, Toyota (JP); Naoyuki Tsuzuki, Toyota (JP); Yasutaka Nishimura, Nisshin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 60 days.

(21) Appl. No.: 18/675,243

(22) Filed: May 28, 2024

(65) Prior Publication Data

US 2025/0074571 A1 Mar. 6, 2025

(30) Foreign Application Priority Data

Sep. 1, 2023 (JP) ..... 2023-142471

(51) Int. Cl.
*B63H 25/00* (2006.01)
*B63H 25/04* (2006.01)

(52) U.S. Cl.
CPC ..... *B63H 25/04* (2013.01)

(58) Field of Classification Search
CPC ..... B63H 25/04
USPC ..... 701/21
See application file for complete search history.

(56) References Cited

U.S. PATENT DOCUMENTS

| | | | | |
|---|---|---|---|---|
| 2019/0308713 | A1 | 10/2019 | Akuzawa et al. | |
| 2019/0361457 | A1* | 11/2019 | Johnson | G05D 1/0206 |
| 2020/0080846 | A1 | 3/2020 | Yamazaki et al. | |
| 2022/0001970 | A1 | 1/2022 | Hara et al. | |
| 2022/0291688 | A1* | 9/2022 | Afman | G05D 1/0206 |

FOREIGN PATENT DOCUMENTS

| | | | |
|---|---|---|---|
| JP | 2011-128943 | A | 6/2011 |
| JP | 2020-040470 | A | 3/2020 |
| JP | 2021-076537 | A | 5/2021 |
| JP | 2022-106753 | A | 7/2022 |
| WO | 2018/100746 | A1 | 6/2018 |
| WO | 2020/111044 | A1 | 6/2020 |

* cited by examiner

*Primary Examiner* — Tiffany P Young
(74) *Attorney, Agent, or Firm* — SoraIP, Inc.

(57) ABSTRACT

The control device includes a control unit. The control unit sets the first intermediate target point within the range of waters when the ship is located outside the range of waters capable of starting the automatic steering to the target docking point. When the distance of the vector connecting the position of the ship and the first intermediate target point and the angle between the bow direction of the ship and the direction of the vector satisfy a predetermined criterion, the control unit formulates a route to be sailed by the ship from the position of the ship to the target docking point via the set first intermediate target point. The control unit automatically steers the ship according to the established route.

11 Claims, 5 Drawing Sheets

CONTROL DEVICE AND CONTROL METHOD

CROSS-REFERENCE TO RELATED APPLICATION

This application claims priority to Japanese Patent Application No. 2023-142471 filed on Sep. 1, 2023, incorporated herein by reference in its entirety.

BACKGROUND

1. Technical Field

The present disclosure relates to a control device and a control method.

2. Description of Related Art

There conventionally is known technology related to docking control of a ship. For example, Japanese Unexamined Patent Application Publication No. 2020-40470 (JP 2020-40470 A) discloses technology for supporting docking operations of a ship.

SUMMARY

From a safety standpoint, docking control of a ship cannot be initiated when a point at which the ship is located is not within an appropriate distance and azimuth range with respect to a target docking point, or when there is an obstruction between the point at which the ship is located and the target docking point. Accordingly, there is room for improvement in the technology related to docking control of ships, from the viewpoint of convenience and safety.

In view of such circumstances, an object of the present disclosure is to improve technology regarding docking control of a ship.

A control device according to an embodiment of the present disclosure is a control device for automatically steering a ship, and includes a control unit that sets, when the ship is at a position outside of a range of waters in which initiating automatic steering to a target docking point is allowable, a first intermediate target point within the range of waters, plots a route for the ship to sail, from the position of the ship to the target docking point, via the first intermediate target point that is set, when a distance of a vector connecting the position of the ship and the first intermediate target point, and an angle between a bow direction of the ship and a direction of the vector, satisfy predetermined criteria, and automatically steers the ship in accordance with the route that is plotted.

A control method according to an embodiment of the present disclosure is a control method executed by a control device that automatically steers a ship, the control device executing setting, when the ship is at a position outside of a range of waters in which initiating automatic steering to a target docking point is allowable, a first intermediate target point within the range of waters, plotting a route for the ship to sail, from the position of the ship to the target docking point, via the first intermediate target point that is set, when a distance of a vector connecting the position of the ship and the first intermediate target point, and an angle between a bow direction of the ship and a direction of the vector, satisfy predetermined criteria, and automatically steering the ship in accordance with the route that is plotted.

According to an embodiment of the present disclosure, technology regarding docking control of a ship is improved.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Hereinafter, embodiments of the present disclosure will be described.

SUMMARY OF THE EMBODIMENT

Figure 1:
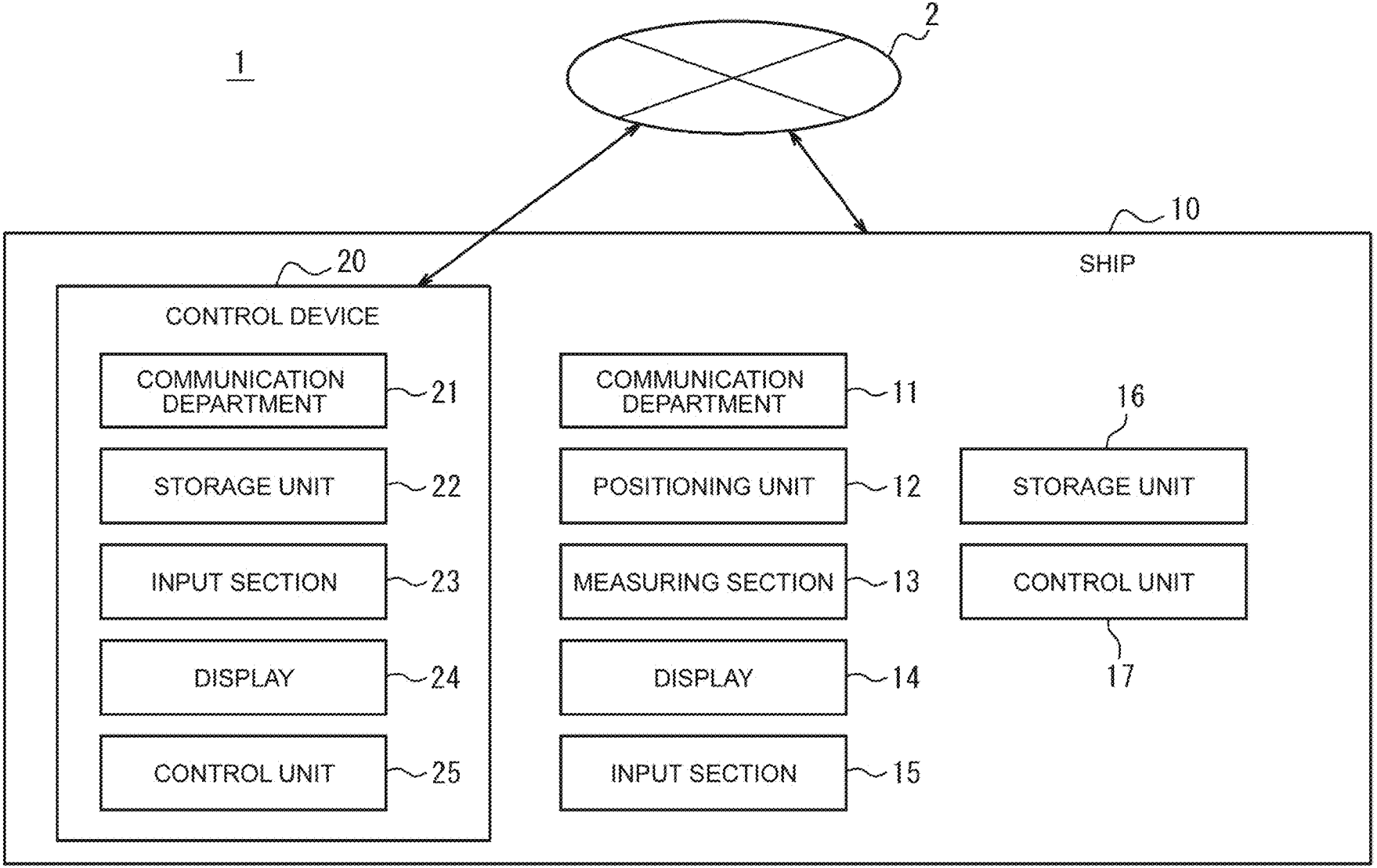
FIG. 1 is a block diagram illustrating a schematic configuration example of a system according to an embodiment of the present disclosure.

With reference to FIG. 1, an outline of a system 1 according to an embodiment of the present disclosure will be described. The system 1 includes a ship 10 and a control device 20. The ship 10 and the control device 20 are communicably connected to a network 2 including, for example, the Internet and a mobile communication network.

The ship 10 includes a control device 20. The ship 10 is communicably connected to the control device 20 by a wire. The ship 10 may be communicably connected to the control device 20 via the network 2.

The control device 20 is a computer provided in the ship 10. The control device 20 performs automatic steering for causing the ship 10 to dock at the target docking point. The control device 20 can communicate with the ship 10 by wire. The control device 20 can communicate with the ship 10 via the network 2.

First, an outline of the present embodiment will be described, and details will be described later. The control device 20 sets the first intermediate target point within the range of waters when the ship 10 is located outside the range of waters capable of starting the automatic steering to the target docking point. When the distance of the vector connecting the position of the ship 10 and the first intermediate target point and the angle between the bow direction of the ship 10 and the direction of the vector satisfy a predetermined criterion, the control device 20 formulates a route to be sailed by the ship 10 from the position of the ship 10 to the target docking point via the set first intermediate target point. The control device 20 automatically steers the ship 10 according to the established route.

As described above, according to the present embodiment, even in a case where the ship 10 is sailing outside the range of waters capable of starting the automatic steering to the target docking point, the first intermediate target point is set in the waters. Further, the angle between the distance and the bow direction of the vector connecting the position of the ship 10 and the first intermediate target point satisfies a predetermined criterion, so that a route is plotted for the ship 10 to sail from the position of the ship 10 to the target docking point by automatic steering. Therefore, the technology related to the docking control of the ship 10 is improved in that the safety and convenience of the ship helmsman docking the ship 10 to the target docking point are improved.

Next, each configuration of the system 1 will be described in detail.

Composition of the Ship

As illustrated in FIG. 1, the ship 10 includes a communication unit 11, a positioning unit 12, a measurement unit 13, a display unit 14, an input unit 15, a storage unit 16, a control unit 17, and a control device 20. Details of the control device 20 will be described later.

The communication unit 11 includes both a communication interface connected to the network 2 and a communication interface wired to the communication unit 21 of the control device 20. The communication interfaces connected to the network 2 correspond to mobile communication standards such as 4G (4th Generation) or 5G (5th Generation), but are not limited thereto, and may correspond to any communication standard. In the present embodiment, the ship 10 is connected to the communication unit 21 of the control device 20 via the communication unit 11 so as to be able to communicate with each other by wire. Further, the ship 10 may be wirelessly connected to the communication unit 21 of the control device 20 via the communication unit 11 and the network 2.

The positioning unit 12 includes one or more devices that acquire position information of the ship 10. Specifically, the positioning unit 12 includes, for example, a receiver corresponding to GPS, but is not limited thereto, and may include a receiver corresponding to any satellite-based positioning system.

The measurement unit 13 includes one or more sensors. The measurement unit 13 may include a sonar, a radar, a gyro compass, a magnetic compass, an acceleration sensor, an atmospheric pressure sensor, and the like. However, the sensor included in the measurement unit 13 is not limited to these sensors.

The display unit 14 includes at least one display interface capable of displaying characters or images. The display unit 14 is, for example, a chart plotter, but is not limited thereto. The display interfaces are, for example, displays such as LCD or organic EL displays. However, the display interface is not limited thereto. The display unit 14 displays, together with the map information, information such as the position of the ship 10, the sailing route, the intermediate target point, the target docking point, and the waters.

The input unit 15 is configured to include at least one input interface capable of accepting an input by a helmsman of the ship 10. The input interface is, for example, a physical key, a capacitive key, a pointing device, a camera, a touch screen integrally provided with the display of the display unit 14 described above, or a microphone that collects the voice of the helmsman. However, the input interface is not limited thereto.

The storage unit 16 includes one or more memories. The memory is, for example, a semiconductor memory, a magnetic memory, an optical memory, or the like, but is not limited thereto. Each memory included in the storage unit 16 may function as, for example, a main storage device, an auxiliary storage device, or a cache memory. The storage unit 16 stores arbitrary information used for the operation of the ship 10. For example, the storage unit 16 may store a system program, an application program, embedded software, map information, a list of target docking points, and the like. The information stored in the storage unit 16 may be updatable by, for example, information acquired from the network 2 via the communication unit 11.

The control unit 17 may include one or more processors, one or more programmable circuits, one or more dedicated circuits, or a combination thereof. The processor may be, but is not limited to, a general-purpose processor such as, for example, CPU (Central Processing Unit) or GPU (Graphics Processing Unit), or a special-purpose processor specialized for a particular process. The programmable circuitry is, for example, but not limited to, FPGA (Field-Programmable Gate Array). The dedicated circuitry is, for example, but not limited to, ASIC (Application Specific Integrated Circuit). The control unit 17 controls the overall operation of the ship 10.

Configuration of the Control Device

As illustrated in FIG. 1, the control device 20 includes a communication unit 21, a storage unit 22, an input unit 23, a display unit 24, and a control unit 25.

The communication unit 21 includes both a communication interface connected to the network 2 and a communication interface wired to the communication unit 11 of the ship 10. The communication interfaces connected to the network 2 correspond to, for example, a mobile communication standard such as 4G or 5G, but are not limited thereto, and may correspond to any communication standard. In the present embodiment, the control device 20 is connected to the communication unit 11 of the ship 10 via the communication unit 21 so as to be able to communicate with each other by wire. Further, the control device 20 may be wirelessly connected to the communication unit 11 of the ship 10 via the communication unit 21 and the network 2.

The storage unit 22 includes one or more memories. Each memory included in the storage unit 22 may function as, for example, a main storage device, an auxiliary storage device, or a cache memory. The storage unit 22 stores arbitrary information used for the operation of the control device 20. For example, the storage unit 22 may store a system program, an application program, a database, map information, a list of registration points that can be docked, a target docking point of the ship 10 that has received the selection, a route of the ship 10, and the like. The information stored in the storage unit 22 may be updatable by, for example, information acquired from the network 2 via the communication unit 21.

The input unit 23 is configured to include at least one input interface capable of accepting an input by a helmsman of the ship 10. The input interface is, for example, a physical key, a capacitive key, a pointing device, a camera, a touch screen integrally provided with a display of the display unit 24 to be described later, a microphone that picks up the voice of the helmsman, or the like. However, the input interface is not limited thereto.

The display unit 24 includes at least one display interface capable of displaying characters or images. The display interfaces are, for example, displays such as LCD or organic EL displays. However, the display interface is not limited thereto. The display unit 24 may have a function of displaying information such as the position of the ship 10, the route, the intermediate target point, the target docking point, and the waters together with the map information.

The control unit 25 includes one or more processors, one or more programmable circuits, one or more dedicated circuits, or a combination thereof. The control unit 25 controls the overall operation of the control device 20.

Operation Flow of the Control Device

Figure 2:
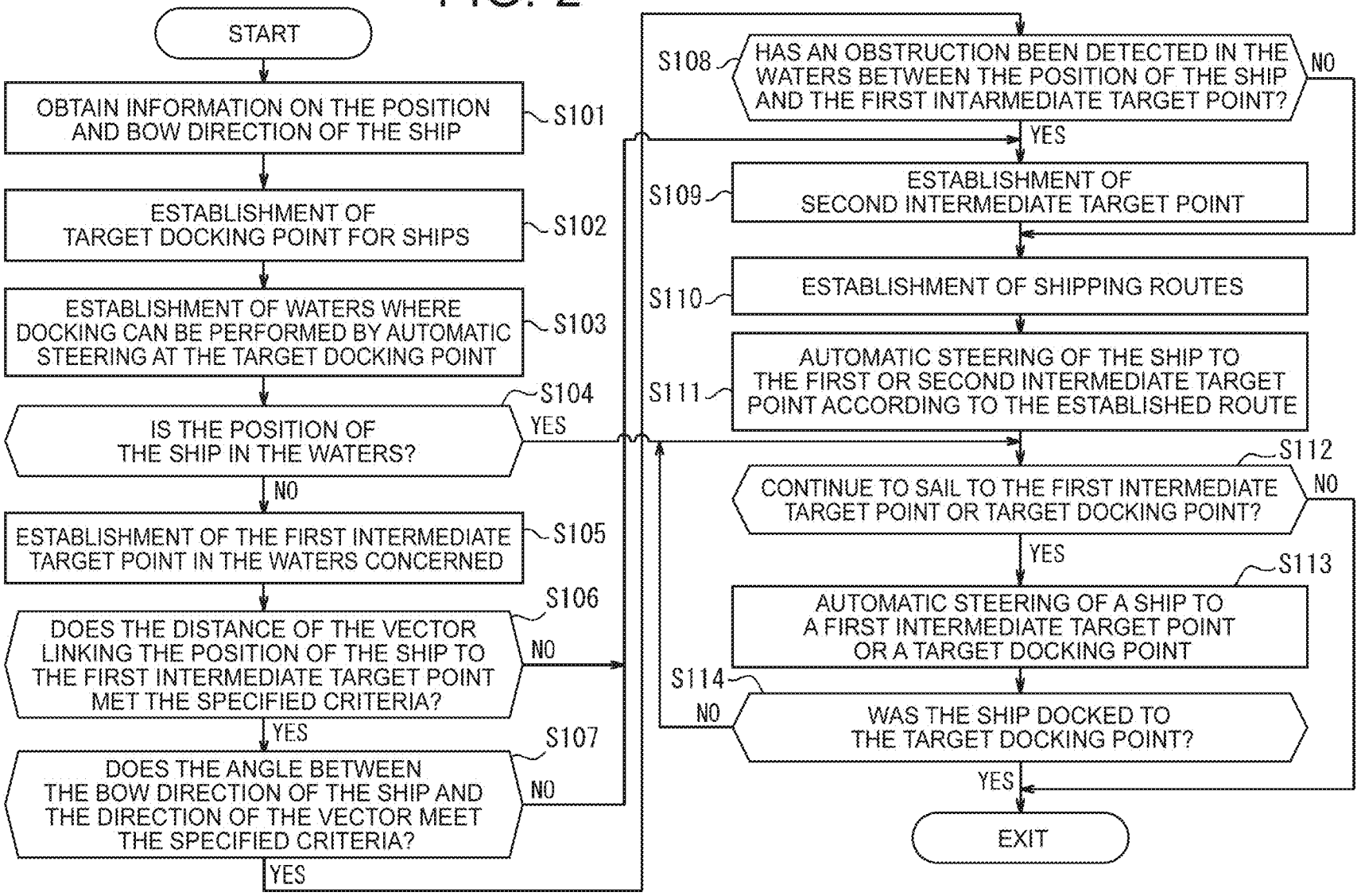
FIG. 2 is a flowchart illustrating an operation example of the control device.

The operation of the control device 20 according to the present embodiment will be described with reference to FIG. 2. The present operation relates to an automatic steer in which the ship 10 docks at a target docking point.

S101: The control unit 25 acquires the positional p1 of the ship 10 and the bow direction d.

Figure 3:
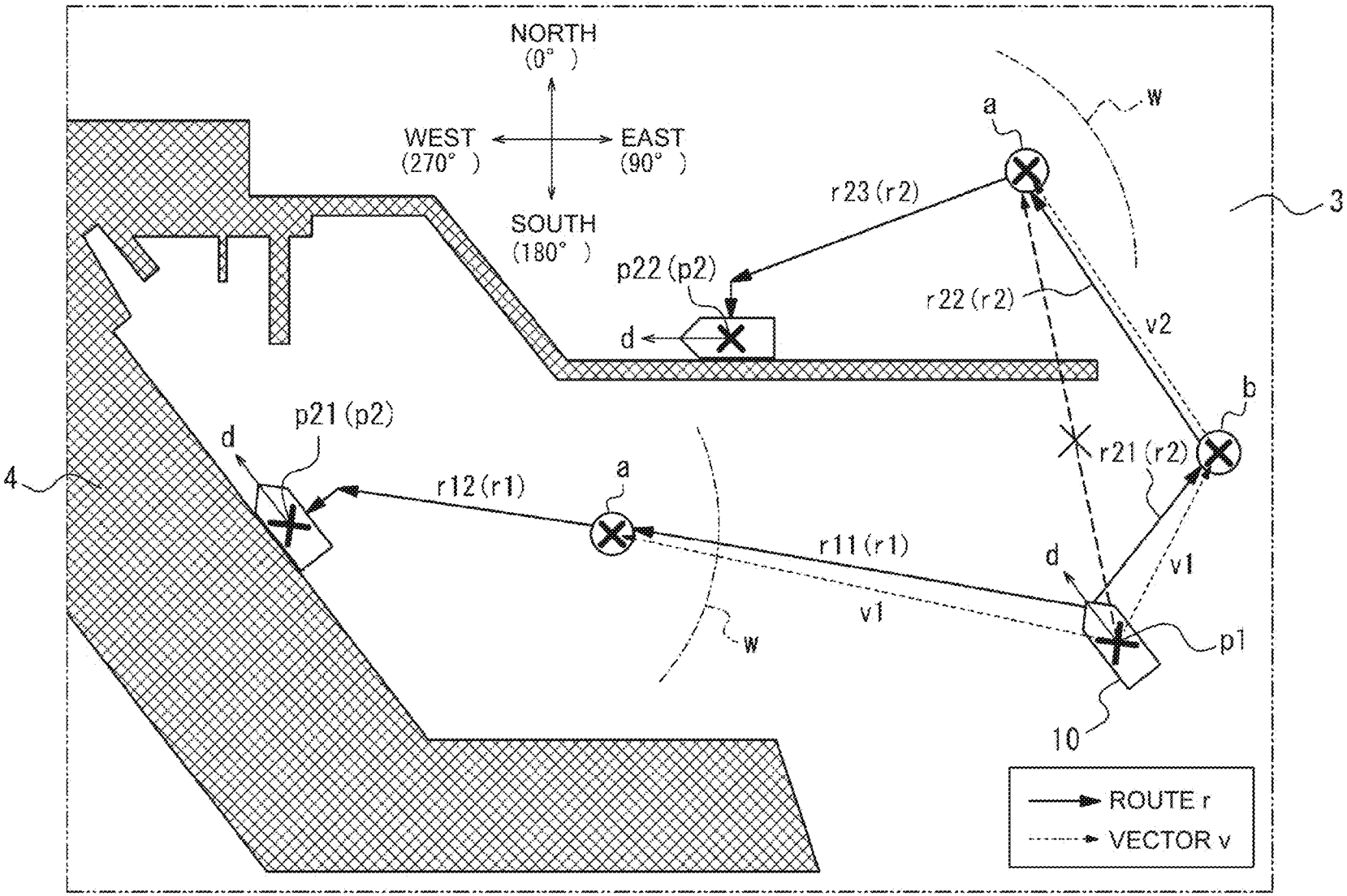
FIG. 3 is a schematic diagram illustrating an example of a route in which a ship sails.

FIG. 3 is a schematic diagram illustrating an example of a traffic route in which the ship 10 sails. In the present disclosure, the ship 10 is described as sailing the ocean 3, but the waters in which the ship 10 sails are not limited to the ocean, and may be a lake, a canal, a river, or the like.

As shown in FIG. 3, the positional p1 of the ship 10 is the latitude and longitude coordinates (x1, y1) of a point where the ship 10 to be sailed is located. The positioning unit 12 of the ship 10 acquires the coordinates (x1, y1) of the position p1 of the ship 10 by, for example, a receiver corresponding to GPS. The control unit 25 acquires, from the positioning unit 12, the position p1 (x1, y1) of the ship 10 via the communication unit 11 and the communication unit 21.

On the other hand, the information in the bow direction d of the ship 10 is an azimuth angle at which the bow of the ship 10 is directed, which is indicated by an arrow. The bow direction d of the ship 10 is measured in one revolution from the north direction to 360° clockwise, with the north direction defined as 0°. The bow direction d is measured by a GPS compass, but the measurement method is not limited thereto. GPS compass is a device that observes phase differences of carrier waves (carriers) of radio waves from GPS satellites using a plurality of GPS antennas, and obtains directions (referred to as baseline vectors) of the antennas with high accuracy with respect to a reference antenna. The bow direction d of the ship 10 may be measured by a gyro compass or a magnetic compass.

S102: The control unit 25 sets a target docking point p2 of the ship 10.

The control unit 25 extracts one or more registered points that are stored in the storage unit 22 and are short from the position p1 of the ship 10, based on the coordinates (x1, y1) of the position p1 of the ship 10 that has been positioned. The control unit 25 displays one or more registration points on the display screen of the display unit 14 of the ship 10 at which the extracted ship 10 can dock. The control unit 25 may transmit information of one or more registration points to the display unit 14 of the ship 10 via the communication unit 21 and the communication unit 11 of the ship 10. In addition, the control unit 25 may display information of one or more registration points on the display screen of the display unit 24 of the control device 20 provided in the ship 10.

When one of the one or more registration points is selected as the target docking point p2 (x2, y2) of the ship 10 on the display screen of the display unit 14, the control unit 25 sets the selected registration point to the target docking point p2. The control unit 25 may store the set target docking point p2 in the storage unit 22.

S103: When the target docking point p2 of the ship 10 is selected, the control unit 25 sets a waters w capable of starting the automatic steering to the selected target docking point p2.

The range of the waters w is determined by the accuracy of the device provided in the positioning unit 12 of the ship 10 for positioning the positional p1 of the ship 10, the size of the ship 10, and the like.

S104: The control unit 25 determines whether or not the position p1 of the ship 10 is located within the range of waters w that can be docked by the automatic steering to the target docking point p2 at which the ship 10 docks. When the ship 10 is located within the range of the waters w, the ship proceeds to S112, and when it is not located within the range of the waters w, the ship proceeds to S105.

When the position p1 of the ship 10 is located within the waters w, the control unit 25 can cause the ship 10 to docking at the target docking point p2 by automatic steering without setting an intermediate target point to be described later.

S105: The control unit 25 sets the first intermediate target point a within the range of waters w when the ship 10 is located outside the range of waters w capable of starting the automatic steering to the target docking point p2.

Figure 4:
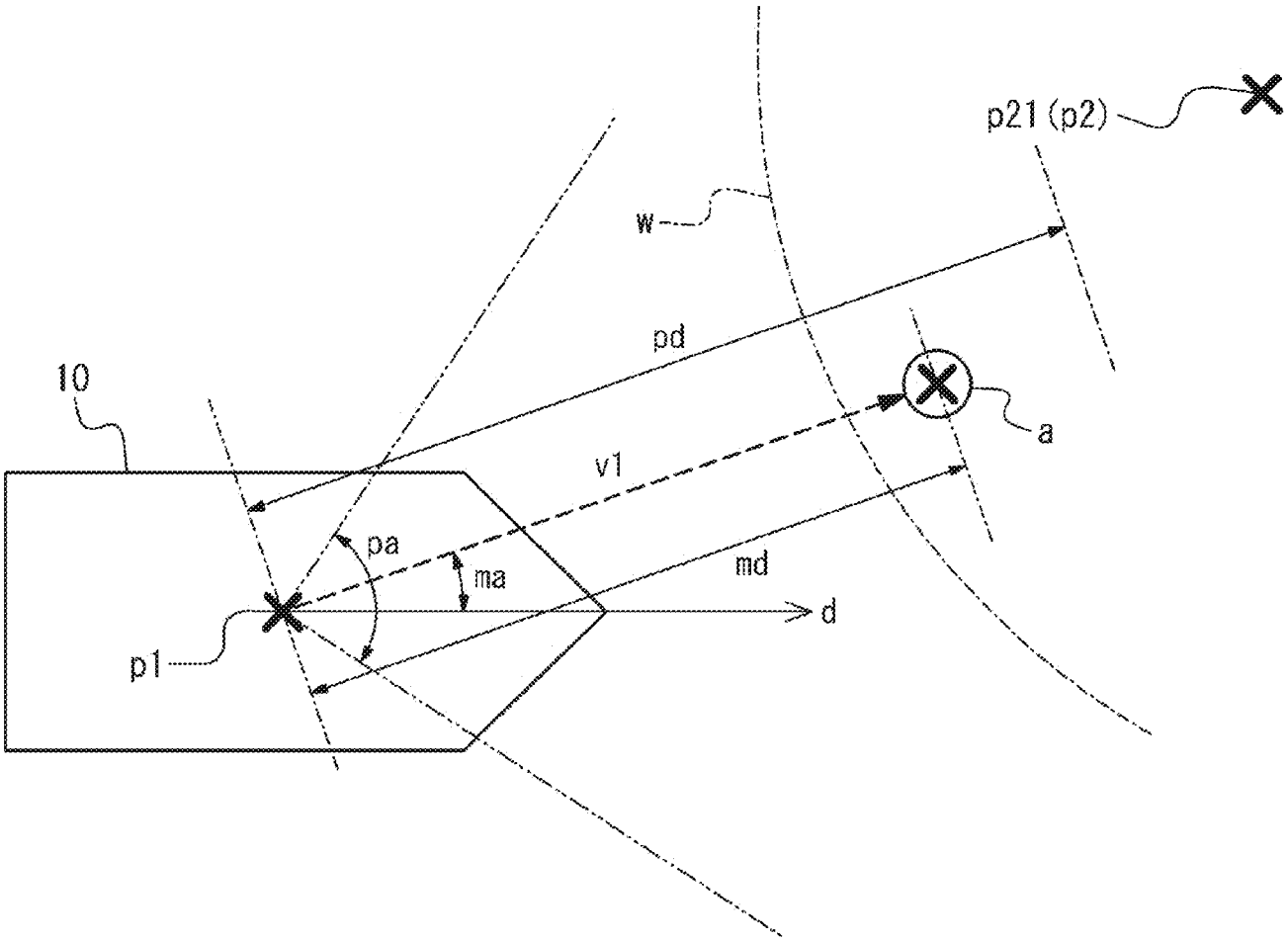
FIG. 4 is a schematic diagram illustrating an exemplary setting of a first intermediate target point.

FIG. 4 is a schematic diagram illustrating a setting example of the first intermediate target point a. The first intermediate target point a is an intermediate target point that is set within a range of waters w capable of starting the automatic steering to the target docking point p2. In the present disclosure, the first intermediate target point a is described as being one, but two or more first intermediate target points a may be set. When the ship 10 reaches the set first intermediate target point a, the control unit 25 can cause the ship 10 to docking p2 the target docking point by automatic steering.

S106: The control unit 25 determines whether or not the distance of the vector v1 connecting the position p1 of the ship 10 and the first intermediate target point a satisfies a predetermined reference c1. If the distance of the vector v1 satisfies the predetermined reference c1, the process proceeds to S107, and if the distance does not satisfy the predetermined reference c1, the process proceeds to S109.

Referring to FIG. 4, a predetermined reference c1 will be described. The predetermined reference c1 is that a distance md (in units of miles) of the vector v1 connecting one point (for example, the position p1 of the ship 10) and another point (for example, the first intermediate target point a) is equal to or smaller than a reference distance pd (in units of miles). In the embodiment illustrated in FIG. 4, since the distance md of the vector v1 is equal to or smaller than the reference distance pd, the predetermined reference c1 is satisfied. A mile (nautical mile) at sea corresponds to 1,852 m.

S107: The control unit 25 determines whether or not the angle between the bow direction d of the ship 10 and the direction of the vector v1 satisfies a predetermined reference c2. If the orientation of the vector v1 satisfies the predetermined reference c2, the process proceeds to S108, and if the orientation of the vector v does not satisfy the predetermined reference c2, the process proceeds to S109.

The predetermined reference c2 is that the angular ma) (°) between the bow direction d of the ship 10 and the direction of the vector v connecting one point and the other point at one point is less than or equal to the reference angle pa (°). In the embodiment illustrated in FIG. 4, since the angle ma) (°) is equal to or less than the reference angle pa (°), the predetermined reference c2 is satisfied.

The control unit 25 displays the position p1 of the ship 10, the first intermediate target point a, the target docking point p2, the waters w capable of starting the automatic steering to the target docking point p2, and the determination result in S105-S107, together with the map information, on the display screen of the display unit 14 of the ship 10.

The display unit 14 of the ship 10 is, for example, a chart plotter. The chartplotter is an electronic device mounted for sailing the ship 10, and displays the position p1, the bow direction d, the velocity, and the like of the ship on the electronic chart. The chartplotter may additionally display information obtained by weather information, wind speed, tide, water depth, fish finder, or various sensors. The display unit 14 of the ship 10 can display the map information. The map information includes maps of waters and coastal areas in the whole of our country or in a predetermined area. In addition to the position p1 and the target docking point p2 of the ship 10, the display unit 14 can display, together with the map information, a first intermediate target point a and a second intermediate target point b, which will be described later, which are set by touch input or the like on a touch screen integrally provided with the display of the display unit 14, for example.

Further, the display unit 24 of the control device 20 may have a function of displaying the position p1 of the ship 10, the target docking point p2, the first intermediate target point a, the waters w capable of starting the automatic steering to the target docking point p2, and the determination result in S105-S107 together with the map information.

S108: The control unit 25 determines whether or not an obstruction is detected in the waters between the position p1 of the ship 10 and the first intermediate target point a. If an obstruction is detected, the process proceeds to S109, and if an obstruction is not detected, the process proceeds to S110.

The obstruction is an artificial structure including a pier (quay) 4 displayed on the display screen, an area where docking is not possible topographically or legally, or an object which is detected by a sensor included in the ship 10 and which hinders the sailing of the ship 10.

The pier (quay) 4, a geographical or legally unable-to-dock area, is obtained from the map information. In addition, an object that interferes with the sailing of the ship 10 floating in the ocean 3 is detected by a sensor included in the measurement unit 13 of the ship 10. The sensor is, for example, a sonar, a radar, or the like, but is not limited thereto. The sonar is a device used as a fish finder in various kinds of ships. A radar is a device that detects an accurate distance to each object by converting a time until a reflected wave is returned into a distance when the emitted radio wave (microwave) is reflected by an object such as another ship or a drift on a traveling line of the radio wave.

S109: The control unit 25 sets the second intermediate target point b in the waters between the position p1 of the ship 10 and the first intermediate target point a.

The second intermediate target point b is an intermediate target point that is set outside the range of waters w capable of starting the automatic steering to the target docking point p2. When an obstruction is detected in the waters between the position p1 of the ship 10 and the first intermediate target point a, the control unit 25 sets a second intermediate target point b in the waters for the ship 10 to sail around the obstruction. The second intermediate target point b is set to satisfy a predetermined criterion c (c1 and c2) between the position p1 of the ship 10 and the second intermediate target point b and between the second intermediate target point b and the first intermediate target point a, respectively.

Further, the control unit 25 sets the second intermediate target point b in the waters between the position p1 of the ship 10 and the first intermediate target point a when the vector v1 range md connecting the position p1 of the ship 10 and the first intermediate target point a or the angular ma between the bow direction d of the ship 10 and the direction of the vector v1 does not satisfy the predetermined reference c (c1 and c2). The second intermediate target point b is set to satisfy a predetermined criterion c (c1 and c2) between the position p1 of the ship 10 and the second intermediate target point b and between the second intermediate target point b and the first intermediate target point a.

Figure 5:
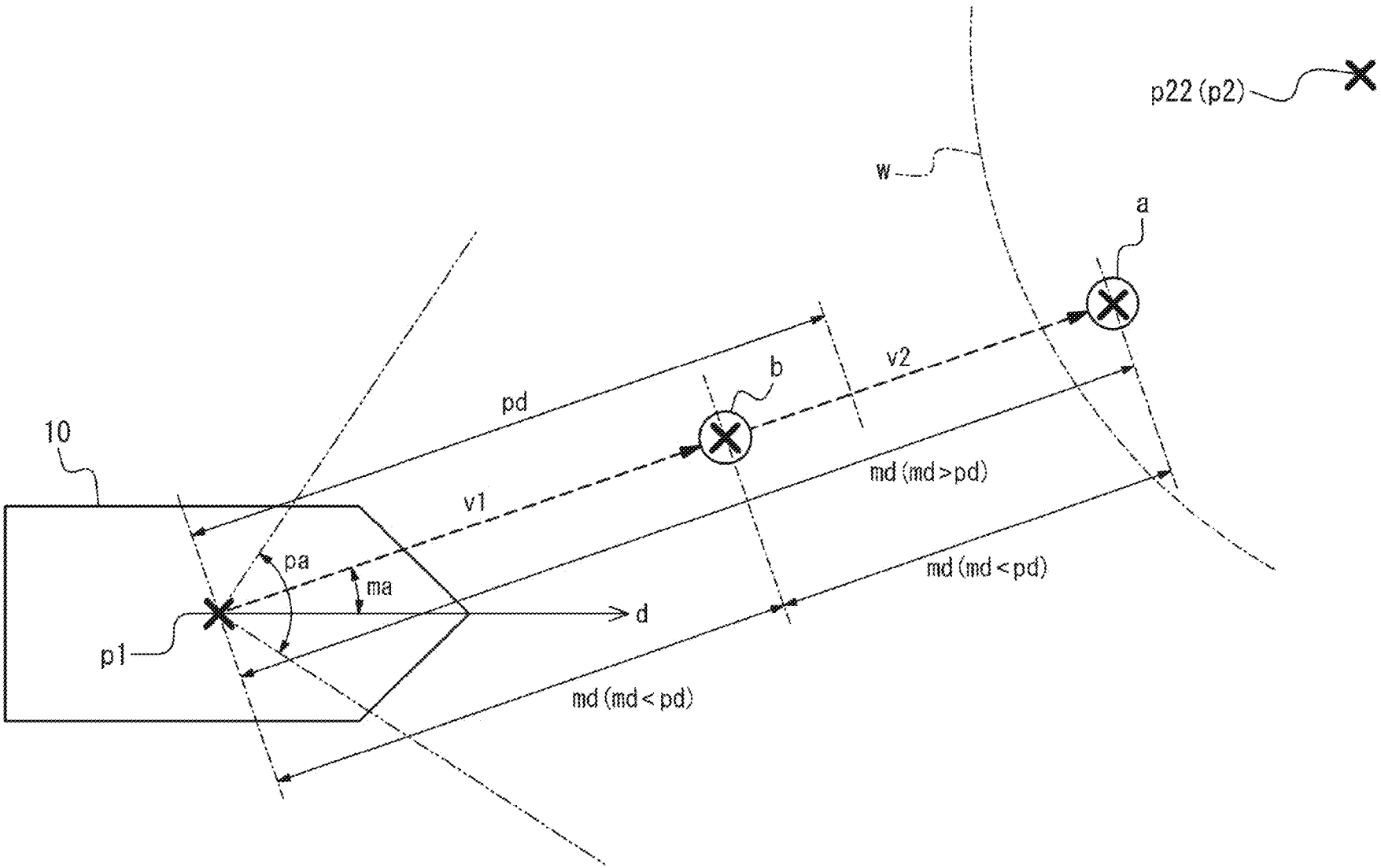
FIG. 5 is a schematic diagram illustrating an example of setting a second intermediate target point.

FIG. 5 is a schematic diagram illustrating a setting example of the second intermediate target point b. In the embodiment shown in FIG. 5, the angular ma between the bow direction d of the ship 10 and the direction of the vector v1 is equal to or less than the reference angle pa. The distance md of the vector v1 connecting the position p1 of the ship 10 and the first intermediate target point a is equal to or smaller than the reference distance pd.

The control unit 25 prompts the input of the second intermediate target point b on the touch screen of the input unit 15 integrally provided with the display screen of the display unit 14. When the second intermediate target point b is input on the touch screen, the control unit 25 receives the input of the second intermediate target point b. As shown in FIG. 5, the control unit 25 sets the second intermediate target point b in the waters between the position p1 of the ship 10 and the first intermediate target point a so as to satisfy the predetermined criterion c (c1 and c2) between the position p1 of the ship 10, the second intermediate target point b, and the second intermediate target point b and the first intermediate target point a.

In FIG. 3, when the ship 10 docks at the target docking point p22, the following setting is required.

(1) The first intermediate target point a is set to be within a range of a waters w capable of starting the automatic steering to the target docking point p2.

(2) The second intermediate target point b is set so as to satisfy the following condition.

(i) The distance md of the vector v1 connecting the position p1 of the ship 10 and the intermediate target point a1 is equal to or smaller than the reference distance pd, and the angular ma between the bow direction d of the ship 10 and the direction of the vector v1 is equal to or smaller than the reference angle pa.

(ii) The distance v2 of the vector md connecting the second intermediate target point b and the first intermediate target point a is equal to or smaller than the reference distance pd, and the angular ma between the bow direction d of the ship 10 and the direction of the vector v2 is equal to or smaller than the reference angle pa.

By setting the first intermediate target point a and the second intermediate target point b in this manner, the control unit 25 can automatic steering the ship 10 in the route r21 from the position p1 of the ship 10 to the second intermediate target point b, the route r22, from the second intermediate target point b to the first intermediate target point a, and the route r23 from the first intermediate target point a to the target docking point p22.

Further, as shown in FIG. 3, when the pier 4 (obstruction) is detected in the waters between the position p1 of the ship 10 and the target docking point p2 of the ship 10, the control unit 25 receives the input of the second intermediate target point b for the ship 10 to sail around the obstruction in the waters on the touch screen of the input unit 15 integrally provided with the display screen of the display unit 14. The control unit 25 sets the second intermediate target point b. The second intermediate target point b may be set to a plurality of points in order to sail around the obstruction.

S110: When the position p1 of the ship 10, the distance of the vector v1 connecting the first intermediate target point a, and the angle between the bow direction d of the ship 10 and the direction of the vector v1 satisfy the predetermined reference c (c1 and c2), when the second intermediate target point b is set from the position p1 of the ship 10, the control unit 25 formulates a route r through which the ship 10 sails to the target docking point p2 through the second intermediate target point b and the first intermediate target point a.

Two or more second intermediate target points b (b1, b2, . . . , bn) may be set in order to sail around an obstruction or to satisfy a predetermined criterion c (c1 and c2). When two or more second intermediate target points b are set in the waters between the position p1 of the ship 10 and the first intermediate target point a, the control unit 25 receives the selection of the order of arrival of the ship 10 to each of the two or more second intermediate target points b. The control unit 25 may establish the route r by associating the position p1 of the ship 10, each of the two or more second intermediate target points b for which the arrival order is set, the first intermediate target point a, and the target docking point p2. When the order of reaching each of the two or more second intermediate target points b (b1, b2, . . . , bn) is selected on the touch screen of the input unit 15 integrally provided with the display screen of the display unit 14, the control unit 25 receives the selection of the order of reaching. The control unit 25 associates the position p1 of the ship 10, each of the two or more second intermediate target points b (b1, b2, . . . , bn) in which the arrival order is set, the first intermediate target point a, and the target docking point p2 with each other to create the route r. When two or more first intermediate target points a are set, the control unit 25 may further accept selection of the order of arrival of the ship 10 to each of the two or more first intermediate target points a (a1, a2, . . . , an). In this case, the control unit 25 associates the position p1 of the ship 10, each of the two or more second intermediate target points b for which the arrival order is set, each of the two or more first intermediate target points a for which the arrival order is set, and the target docking point p2 with each other, and formulates the route r.

As shown in FIG. 3, for example, the control unit 25 formulates a route r1 from the position p1 of the ship 10 to the target docking point p21 via the first intermediate target point a, and a route r2 from the position p1 of the ship 10 to the target docking point p22 via the second intermediate target point b and the first intermediate target point a. The control unit 25 may store the established route r1 and route r2 in the storage unit 22.

S111: The control unit 25 automatically steers the ship 10 to the first intermediate target point a or the second intermediate target point b according to the established route r.

When one of the one or more routes r stored in the storage unit 22 is selected, the control unit 25 reads the information of the selected route r and automatically steers the ship 10. The information on the route r includes, but is not limited to, the order of arrival of the ship 10 from the position p1 to the target docking point p2 through each of the intermediate target points, the latitude and longitude coordinates (x1, y1) of each point, the waters in which the obstruction exists, and the like. In the embodiment illustrated in FIG. 3, a route p1 from the position p21 of the ship 10 to the target docking point r1 via the first intermediate target point a, a second intermediate target point b from the position p1 of the ship 10, and a route r2 from the first intermediate target point a to the target docking point p22 are established. The route r1 and the route r2 are stored in the storage unit 22. For example, the route r2 is selected on the touch screen integrally provided with the display unit 24 of the control device 20 or the display screen of the display unit 14 of the ship 10. The control unit 25 reads the data of the route r2. The control unit 25 automatically steers the ship 10 from the position p1 of the ship 10 to the target docking point p22 through the second intermediate target point b and the first intermediate target point a.

S112: When arriving at the first intermediate target point a or the second intermediate target point b, the control unit 25 determines whether or not to continue the sailing of the ship 10 to the first intermediate target point a or the target docking point p2. If the ship 10 continues to sail, the process proceeds to S113, and if not, the control of the ship 10 is terminated.

When the ship 10 arrives at the first intermediate target point a or the second intermediate target point b, the ship helmsman visually confirms the safety of the obstructions on the traffic route or the sailing state of another ship. Therefore, the control unit 25 prompts the user to input whether or not to continue the control to the target docking point p2 or the first intermediate target point a on the touch screen integrally provided with the display screen of the display unit 24 or the display unit 14. If it is input that there is no continuation, or if there is no input, the control unit 25 keeps the ship 10 at the point where it arrived, and ends the control of the ship 10.

S113: The control unit 25 automatically steers the ship 10 on the basis of the data of the route r established in S110 in the route from the first intermediate target point a or the second intermediate target point b to the first intermediate target point a or the target docking point p2 among the established routes r.

S114: The control unit 25 determines whether or not the ship 10 has docked on the target docking point p2. If the ship 10 is not docking at the target docking point p2, the process returns to S112, and if it is docking, the automatic steering of the ship 10 is terminated.

As described above, the control device 20 according to the present embodiment sets the first intermediate target point a within the range of waters w when the ship 10 is located outside the range of waters w capable of starting the automatic steering to the target docking point p2. When the distance of the vector v1 connecting the position of the ship 10 and the first intermediate target point a and the angle between the bow direction d of the ship 10 and the direction of the vector v1 satisfy the predetermined criterion c (c1 and c2), the control device 20 formulates a route r to be sailed by the ship 10 from the position p1 of the ship 10 to the target docking point p2 through the set first intermediate target point a. The control device 20 automatically steers the ship 10 according to the established route r.

As described above, according to the present embodiment, even when the ship 10 is sailing outside the waters w capable of starting the automatic steering to the target docking point p2, by setting the first intermediate target point a in the waters w, the route r in which the ship 10 docks p2 the target docking point by the automatic steering is established. Therefore, the technique related to the docking control of the ship 10 is improved in that the safety and convenience of the ship helmsman docking the ship 10 to the target docking point p2 are improved.

Although the present disclosure has been described with reference to the drawings and examples, it is noted that various changes and modifications may be made by those skilled in the art based on the present disclosure. It should therefore be noted that these variations and modifications are within the scope of the present disclosure. For example, the functions or the like included in each component or each step or the like can be rearranged so as not to logically contradict each other, and a plurality of components or steps or the like can be combined or divided into one.

For example, in the above-described embodiment, the configuration and operation of the control device 20 may be distributed among a plurality of computers capable of communicating with each other. Further, for example, an embodiment in which some or all of the components of the control device 20 are provided in the ship 10 or the portable terminal 30 is also possible. For example, the display device provided in the ship 10, the control device 20, or the portable terminal 30 may appropriately share the display function of information.

In the present embodiment, a case has been described in which the control device 20 automatically steers the ship 10 in accordance with the established route r. If there is a section of a traffic route in the traffic route r that is difficult to satisfy the predetermined criterion c, for example, between the position p1 of the ship 10 and the intermediate target point or between the intermediate target points, the ship 10 may be manually steered in the section of the traffic route.

Further, for example, an embodiment in which a general-purpose computer functions as the control device 20 according to the above-described embodiment is also possible. Specifically, a program describing processing contents for realizing each function of the control device 20 according to the above-described embodiment is stored in a memory of a general-purpose computer, and the program is read and executed by a processor. Accordingly, the present disclosure can also be implemented as a program executable by a processor or a non-transitory computer-readable medium storing the program.

What is claimed is:

1. A control device for automatically steering a ship including a sensor configured to detect an obstruction in waters, the control device comprising:

a processor configured to determine whether the ship is at a first position that is inside of a first range of the waters or the ship is at a second position that is outside of the first range, set a first intermediate target point within the first range in a case where the processor determines that the ship is at the second position, determine whether a first distance of a first vector connecting the second position and the first intermediate target point is equal to or smaller than a first predetermined distance, determine whether a first angle between a bow direction of the ship and a first direction of the first vector is equal to or smaller than a predetermined angle, determine whether the sensor detects the obstruction in the waters between the second position and the first intermediate target point, determine whether a second distance of a second vector connecting the first intermediate target point and a third position is equal to or smaller than the first predetermined distance, the third position being between the second position and the first intermediate target point, determine whether a second angle between the bow direction and a second direction of the second vector is equal to or smaller than the predetermined angle, set the third position as a second intermediate target point in a case where the processor determines that the sensor detects the obstruction in the waters between the second position and the first intermediate target point, that the second distance is equal to or smaller than the first predetermined distance, and that the second angle is equal to or smaller than the predetermined angle, plot a route that the ship sails, the route being from the second position of the ship to a target docking point, via the first intermediate target point and the second intermediate target point, in a case where the processor determines that the first distance is equal to or smaller than the first predetermined distance and the first angle is equal to or smaller than the predetermined angle, and automatically steer the ship in accordance with the route that the processor plots.

2. The control device according to claim 1, wherein the processor is further configured to:

accept selection of order of arrival of the ship at each of two or more second intermediate target points in a case where the two or more second intermediate target points are set in the waters between the second position and the first intermediate target point; and plot the route, by associating the second position, each of the two or more second intermediate target points based on the selection of the order of arrival, the first intermediate target point, and the target docking point.

3. The control device according to claim 1, wherein the obstruction is an artificial structure.

4. The control device according to claim 3, wherein the artificial structure is a pier or a quay.

5. The control device according to claim 1, wherein the obstruction is an area that docking is not possible due to topographical or legal constraints.

6. The control device according to claim 1, wherein the obstruction is an object that hinders sailing of the ship.

7. A control method executed by a processor configured to automatically steer a ship including a sensor configured to detect an obstruction in waters, the control method comprising:

determining whether the ship is at a first position that is inside of a first range of the waters or the ship is at a second position that is outside of the first range;

setting a first intermediate target point within the first range in a case where the ship is at the second position;

determining whether a first distance of a first vector connecting the second position and the first intermediate target point is equal to or smaller than a first predetermined distance;

determining whether a first angle between a bow direction of the ship and a first direction of the first vector is equal to or smaller than a predetermined angle;

determining whether the sensor detects the obstruction in the waters between the second position and the first intermediate target point;

determining whether a second distance of a second vector connecting the first intermediate target point and a third position is equal to or smaller than the first predetermined distance, the third position being between the second position and the first intermediate target point;

determining whether a second angle between the bow direction and a second direction of the second vector is equal to or smaller than the predetermined angle;

setting the third position as a second intermediate target point in a case where the sensor detects the obstruction in the waters between the second position and the first intermediate target point, the second distance is equal to or smaller than the first predetermined distance, and the second angle is equal to or smaller than the predetermined angle;

plotting a route that the ship sails, the route being from the second position of the ship to a target docking point, via the first intermediate target point that is set and the second intermediate target point that is set, in a case where the first distance is equal to or smaller than the first predetermined distance and the first angle is equal to or smaller than the predetermined angle; and automatically steering the ship in accordance with the route that is plotted.

8. The control method according to claim 7, wherein the obstruction is an artificial structure.

9. The control method according to claim 8, wherein the artificial structure is a pier or a quay.

10. The control method according to claim 7, wherein the obstruction is an area that docking is not possible due to topographical or legal constraints.

11. The control method according to claim 7, wherein the obstruction is an object that hinders sailing of the ship.

* * * * *